United States Patent [19]
Nayar
[11] 4,106,931
[45] Aug. 15, 1978

[54] METHODS FOR SINTERING POWDER METALLURGY PARTS

[75] Inventor: Harbhajan S. Nayar, Plainfield, N.J.

[73] Assignee: Airco, Inc., Montvale, N.J.

[21] Appl. No.: 798,052

[22] Filed: May 18, 1977

[51] Int. Cl.[2] ..... B22F 3/00
[52] U.S. Cl. ..... 75/201; 75/224; 148/16; 252/373; 252/374
[58] Field of Search ..... 75/224, 201, 242; 148/126, 16; 252/372–377

[56] References Cited

U.S. PATENT DOCUMENTS

| | | | |
|---|---|---|---|
| 2,299,138 | 10/1942 | Gier | 252/372 |
| 2,333,573 | 11/1943 | Kalischer | 75/224 X |
| 2,411,073 | 11/1946 | Whitney | 75/224 X |
| 3,891,473 | 6/1975 | Latra | 75/224 X |
| 3,986,900 | 10/1976 | Rademacher | 252/372 |
| 4,049,472 | 9/1977 | Arndt | 148/16 |
| 4,057,510 | 11/1977 | Crouch et al. | 252/372 |

OTHER PUBLICATIONS

Hausner, H. H. handbook of Powder Metallurgy, Chemical Pub. Co., N.Y., 1973, pp. 190, 193.
Hirschhorn, J. S. Intro. to Powder Met. Am. Powd. Met. Inst., N.Y. 1969, pp. 216–231.
Goetzel, C. G. Treatise on Powder Met. vol. I. Interscience, N.Y. 1949. pp. 621–649.

*Primary Examiner*—Richard E. Schafer
*Attorney, Agent, or Firm*—David L. Rae; Larry R. Cassett; Edmund W. Bopp

[57] ABSTRACT

Steel powder metallurgy parts having approximately 0.2 to 10% carbon in the form of graphite and approximately 1% lubricant are sintered in the hot zone of a furnace under temperatures of approximately 2050° F for periods of up to approximately 1.0 hour under an atmosphere comprised of at least 90% nitrogen, up to 9.75% hydrogen and carbon monoxide with a maximum 5% carbon monoxide, 0.25–2.0% methane or equivalent hydrocarbon and a dewpoint of the mixed atmosphere of less than −60° F.

7 Claims, No Drawings

METHODS FOR SINTERING POWDER METALLURGY PARTS

BACKGROUND

The present invention relates to methods for sintering powder metallurgy parts and more particularly to methods for sintering steel powder metallurgy parts in nitrogen based atmospheres.

In producing powder metallurgy parts it is common to pass 'green' compacts through a sintering furnace typically comprised of a preheat section, high temperature (hot zone) section and a cooling section which sections are supplied with a controlled atmosphere. The most widely used controlled atmosphere used with sintering furnaces has heretofore been endothermic gas which is typically comprised of 40–45% nitrogen, 19–21% carbon monoxide, 32–39% hydrogen and 0.2–0.6% methane with the foregoing gas mixture having a dewpoint between +20° to +50° F. Endothermic gas has been widely used for sintering due to its low cost and tolerant nature which enables powder metallurgy parts to be sintered under relatively high dewpoints. In addition, the carbon available from the minor methane fraction of endothermic gas counteracts a decarburizing effect caused by the reaction between oxygen carried into the sintering furnace by such parts and added graphite. One major disadvantage attributable to endothermic gas is that substantial quantities of natural gas or other hydrocarbon sources are required for its production. Typically, 450 SCF of natural gas are required to produce each 1,000 SCF of endothermic gas and consequently, large quantities of a relatively scarce and expensive resource, natural gas, are required for producing endothermic gas. In addition, sintering under endothermic gas at temperatures of 2050° F or so tends to decarburize powder metallurgy parts due to the high dewpoint (moisture content) of endothermic gas. Furthermore, the chemistry of natural gas utilized to generate endothermic gas is not consistent and in order to effectively sinter powder metallurgy parts, relatively expensive analytical instruments and control devices must be utilized.

Other atmospheres such as purified exothermic gas, which is generated from burning approximately 6 parts of air with one part of natural gas and subsequently removing $CO_2$ and moisture, has been utilized. This gas is essentially comprised of 75% nitrogen, 11% carbon monoxide and 13% hydrogen, with a dewpoint of approximately −40° F. Although purified exothermic gas does not require as much natural gas for its production as does endothermic gas, exothermic gas has been found suitable as a controlled sintering atmosphere only when the desired surface carbon content of a part being sintered or treated is less than 0.3%. Accordingly, purified exothermic gas is not preferred as a controlled atmosphere for use during sintering of powder metallurgy parts in which higher surface carbon concentrations are required.

Dissociated ammonia has also been used as controlled sintering atmosphere in sintering processes and generally exhibits a low dewpoint (typically −60° F). This atmosphere (25 $N_2$, 75 $H_2$) is protective, reducing in nature and decarburization is not a problem as long as such dewpoint is maintained and relatively low oxygen concentrations exist in the furnace hot zone. However, as PM parts carry oxygen into the sintering furnace and as such furnaces will inevitably admit some oxygen into the hot zone through leakage, etc., atmospheres such as dissociated ammonia which contain no hydrocarbon constituents to counteract decarburization. Furthermore, as ammonia is generally a by-product of processes in which hydrocarbons such as natural gas are required and consequently, the production of dissociated ammonia relies upon natural gas as a feed stock.

Nitrogen gas alone has been utilized as a sintering atmosphere and in the event the dewpoint of such atmosphere can be maintained below −60° F, sintering powder metallurgy steel parts will be generally effective. However, as virtually all furnaces have some leaks through which atmospheric air may enter, the effectiveness of nitrogen alone as a sintering atmosphere decreases due to the decarburizing effect of oxygen and other airborne contaminants. Although sintering atmospheres comprised of only nitrogen and 0–10% hydrogen have been utilized, in the event that any significant moisture is present, the hydrogen component of this atmosphere will act as a decarburizing agent and thereby causes significant reductions in surface carbon and hardness.

Accordingly, a clear need exists in the powder metallurgy sintering art for processes wherein controlled atmospheres are utilized to effectively sinter such parts without consuming substantial quantities of natural gas or other hydrocarbons.

OBJECTS

Accordingly, it is an object of the present invention to provide improved methods for sintering powder metallurgy steel parts.

It is a further object of the present invention to provide improved powder metallurgy sintering processes utilizing atmospheres which require substantially lower quantities of hydrocarbon materials than has been heretofore possible.

It is yet another object of the present invention to provide improved powder metallurgy sintering processes in which the surface carbon of parts being sintered is controlled and the loss of surface carbon is minimized.

It is still a further object of the present invention to provide improved methods for sintering powder metallurgy parts which results in minimal decarburization of the core of such parts.

It is still another object of the present invention to provide powder metallurgy sintering processes which enable the dimensions of such parts to be satisfactorily controlled.

Finally it is still another object of the present invention to provide processes for sintering powder metallurgy parts in a safe, essentially explosion-proof atmosphere.

Other objects of the present invention will become apparent from the detailed description of an exemplary embodiment thereof which follows and the novel features of the present invention will be particularly pointed out in conjunction with the claims appended hereto.

SUMMARY

In accordance with the present invention, a method of sintering carbon steel powder metallurgy parts having a density of less than 90% theoretical density and 0.3–1.3% carbon in the form of graphite comprises the steps of heating the hot zone of a sintering furnace to at least 2,000° F; passing said powder metallurgy parts to said hot zone and retaining said parts therein for a period of up to 1 hour; while supplying to said hot zone a controlled atmosphere comprised of at least 90% nitrogen, up to 9.75% hydrogen and carbon monoxide, with said carbon monoxide being less than 5.0%; 0.25–2.00% methane or equivalent hydrocarbon and a dewpoint of −60° F. The foregoing atmosphere may be premixed or various constituents introduced into the furnace through a plurality of locations. The surface carbon of parts sintered in accordance with the foregoing method may be increased slightly and preferably, carbon loss is less than 30% of the carbon supplied as graphite and dimensional control over such powder metallurgy parts during sintering is 0.001 inch per inch of height of such parts.

DESCRIPTION OF PREFERRED EMBODIMENTS

Before describing in detail the process according to the present invention, it is believed helpful to review the important requirments of any powder metallurgy sintering process. Initially, the sintering process should result in good bonding and adequate sintered crush strength or hardness. Secondly, minimum decarburization should occur in the core of the part and, for example, with respect to parts formed of atomized powder (AS 1000) a maximum of 0.15% carbon loss is sustainable. Thus, in the event that carbon is present in the green compact to the extent of 1% as graphite, after sintering, the core for this part should be at least 0.85% carbon. A further requirement of sintering processes is the ability to control surface carbon. There generally will be some loss of surface carbon due to the reaction therewith between oxygen carried in by the green compact although such losses (or even additions) should be on the order of 0.3%. In some cases, it is strongly desired to have surface carbon greater than core carbon in the sintered part by as much as 0.3%. A further requirement of sintering processes is the attainment of safisfactory dimensional control particularly in comparison with sintering under conventional atmospheres such as endothermic gas. Additionally, good pore shape (preferably roundish) is preferred over angular pore shape as this attribute of powder metallurgy parts affects the impact and fatigue properties thereof. Finally, acceptable surface color is also desired.

In accordance with the present invention, the foregoing requirements of sintering processes are met yet the atmospheres utilized during sintering require the consumption of substantially less natural gas or other hydrocarbon sources than has been required heretofore with conventional atmospheres such as endothermic or purified exothermic gas. However, although the atmosphere utilized during sintering is important to the success of such process, the particular furnace used for sintering and various aspects of the powder metallurgy parts being sintered are also of consequence. With respect to furnaces in general, it is possible to evaluate the quality of a given furnace by its ability to maintain a particular dewpoint therein. As those skilled in the art will appreciate, the lower the dewpoint of a sintering atmosphere, the less is the tendency of this atmosphere to result in surface decarburization during sintering. Accordingly, furnaces which have the lowest leakage through which ambient air can enter the same or are "tight" will enable the lowest dewpoints to be obtained therein. Thus, a particular furnace may be subjected to standardized conditions and the dewpoint therein may be measured to determine the "quality rating" of such furnace. For example, in a typical powder metallurgy sintering furnace, with a door opening at either end of 1–2 inches and at least 50% of the sintering atmosphere (nitrogen plus 5–10% hydrogen) being directed toward the entry or inlet door and an asbestos curtain is provided at the exit of the furnace, the dewpoint obtainable during flow of this atmosphere of 100 SCF per inch of width of door and under temperatures of 2050° F may be measured to give the quality rating for a particular furnace. Again, the lower the dewpoint obtained for a particular furnace under the foregoing standardized conditions, which include no parts being passed therethrough, the greater is the ability of parts to withstand decarburization during sintering. Furnaces with quality ratings of less than −10° to −15° C are preferred for sintering powder metallurgy parts in accordance with the present invention.

The particular powder which is compacted to form green compacts which are sintered will also have an effect on the surface and core carbon losses during sintering. Accordingly, powder size, size distribution, the type and amount of lubricant utilized and the quantity of graphite added to such powder will all have an effect on the extent of decarburization occurring during sintering. Furthermore, it has been found that decarburization is less extensive when green compacts formed from atomized powder are used in comparison with compacts formed from sponge iron.

As the composition of powders and green compacts to be sintered in any given furnace and the quality rating of individual furnaces both vary considerably, it is important that the controlled atmosphere selected for use during a particular sintering process be "flexible" enough such that excessive surface and core carbon losses are not sustained. Thus, in accordance with the present invention, an atmosphere for use in sintering powder metallurgy parts is comprised (by volume) of at least 90% nitrogen, up to 9.75% hydrogen plus carbon monoxide, with carbon monoxide being 5% or less, 0.25–2.0% methane or equivalent hydrocarbon and a dewpoing of less than −60° F is preferred. In practice acceptable surface and core carbon losses can be obtained during sintering as the addition of approximately 1% methane tends to carburize parts surfaces and thus reduce surface carbon loss while a minor addition of carbon monoxide is most effective in minimizing core carbon losses. Several experiments have been conducted during which AS 1000 and MH 100 powders have been compacted to 6.88 g./cc. and 6.29 g./cc., respectively, and have been sintered in a furnace with a quality rating (dewpoint) equal to −30° to −35° C. Sintering temperature and time in the hot zone were approximately 2050° F and 40 min. and Table I indicates the results obtained using various atmospheres.

TABLE I

| | AS 1000 (1% C as graphite) | | | |
|---|---|---|---|---|
| Ex. | Atmosphere | Surface %C | Core %C | Hardness ($R_B$) |
| 1 | $N_2$ | 0.63 | 0.86 | 59 |
| 2 | $N_2 + 5H_2$ | 0.44 | 0.87 | 53 |
| 3 | $N_2 + 75H_2$ | 0.61 | 0.88 | 54 |
| 4 | $N_2 + 1.0CH_4$ | 0.80 | 0.88 | 63 |
| 5 | $N_2 + 5H_2 + 1.0CH_4$ | 0.76 | 0.89 | 65 |
| 6 | $N_2 + 5H_2 + 1.0CH_4 + 4CO$ | 0.89 | 0.91 | 62 |
| 7 | $N_2 + 1.0CH_4 + 4CO$ | 0.88 | 0.91 | 63 |

It should be noted that AS 1000 powder contains 1% carbon in the form of graphite. During sintering with atmospheres in accordance with the present invention as indicated in Examples 4–7 of Table I, surface carbon losses of 0.24% or less were obtained while satisfactory core carbon losses also resulted. In addition, the Rockwell B hardness as measured subsequent to sintering was between 62–65 with respect to parts sintered under atmospheres given in Examples 4–7 while the highest Rockwell B hardness obtained using the atmospheres of Examples 1–3 was 59. Accordingly, use of the atmospheres set forth in Examples 4–7 of Table I enables adequate sintering of powder metallurgy parts under typical operating conditions and yet enables such sintering to occur without requiring substantial quantities of hydrocarbon based atmospheres as have been previously required by prior art techniques.

In further experiments, green compacts comprised of MH 100 powder (1.25% carbon as graphite) were sintered under the conditions applicable to Examples 1–7 set forth in Table I above. The results of such experiments indicated as Examples 8–14 are set forth below in Table II:

TABLE II

| | MH 100 (1.25%C as graphite) | | | |
|---|---|---|---|---|
| Ex. | Atmosphere | Surface %C | Core %C | Hardness ($R_B$) |
| 8 | $N_2$ | 0.73 | 1.03 | 50 |
| 9 | $N_2 + 5H_2$ | 0.53 | 1.04 | 47 |
| 10 | $N_2 + 75H_2$ | 0.68 | 1.03 | 49 |
| 11 | $N_2 + 1.0CH_4$ | 1.36 | 1.03 | 55 |
| 12 | $N_2 + 5H_2 + 1.0CH_4$ | 1.48 | 1.05 | 53 |
| 13 | $N_2 + 5H_2 + 1.0CH_4 + 4CO$ | 1.20 | 1.09 | 56 |
| 14 | $N_2 + 1.0CH_4 + 4CO$ | 1.15 | 1.08 | 57 |

Again, usage of atmospheres set forth in Examples 11–14 has resulted in surface carbon losses which are substantially less than those losses obtained during sintering with atmospheres of Examples 8–10 while core carbon losses are comparable throughout Examples 8–14. However, the Rockwell B hardness values obtained during sintering with the atmospheres of Examples 11–14 are consistently above similar values attained during sintering with the atmospheres of Examples 8–10.

It will be appreciated that the atmospheres utilized in processes according to the present invention may be fully premixed or a portion of such atmospheres may be introduced at different locations into the hot zone of a sintering furnace. For example, a portion of the nitrogen and the active ingredient (for example, 1% methane) could be introduced directly into the central portion of the hot zone with the rest of the nitrogen and other constituents introduced separately into the hot zone in the vicinity of the exit and/or entrance thereof. Preferably, at least 50% of the total atmosphere introduced into the hot zone is directed to the entry door thereof. Furthermore, the atmospheres to be utilized with the process according to the present invention may be generated by mixing purified exothermic gas, nitrogen and methane to obtain the requisite propostions of carbon monoxide and hydrogen although as previously noted, the total of these latter constituents should not exceed 9.75% of the atmosphere with carbon monoxide being limited to 5% of such atmosphere or less.

It will be understood that hydrogen and/or carbon monoxide to be used in sintering processes according to the invention, may be generated in the hot zone by passing a mixture of $CH_4$, exothermic or endothermic gas or $H_2O$ or $O_2$ through an "alloy" tube located in the hot zone. The alloy tube could also contain catalytic agents to assist in promoting reactions such as:

$$CH_4 + H_2O \text{ (or } O_2) \rightarrow CO + 3H_2$$

$$CH_4 + CO_2 \rightarrow 2CO + 2H_2$$

However, regardless of the method of producing CO or $H_2$, the volume percent thereof (as a total) is less than 9.75% while the sintering atmosphere is at least 90% nitrogen by volume.

In summary, the sintering process according to the present invention requires atmospheres which are formed from substantially less natural gas or other hydrocarbon sources than is presently utilized in sintering applications. Furthermore, the atmosphere utilized with the process according to the invention are sufficiently flexible to enable sintering of particular compositions in a particular furnace and higher sintering temperatures than 2050° F may be utilized if desired. Furthermore, the nitrogen based sintering atmosphere utilized in accordance with the method of the present invention is essentially inert and non-explosive and the future availability of the primary constituent of such atmospheres (nitrogen) is considered much greater than the future availability of natural gas or other hydrocarbon sources.

The foregoing and other various changes in form and details may be made without departing from the spirit and scope of the present invention. Consequently, it is intended that the appended claims be interpreted as including all such changes and modifications.

What is claimed is:

1. A process for sintering carbon steel powder metallurgy parts having a density of less than 90% theoretical maximum density and 0.3 to 1.3% carbon in the form of graphite in the hot zone of a sintering furnace comprising the steps of heating said hot zone to a temperature of at least 2000° F, passing said parts through said hot zone while supplying to said hot zone an atmosphere comprised of the following constituents by volume: at least 90% nitrogen, up to 9.75% hydrogen and carbon monoxide with said carbon monoxide comprising 5% or less of said atmosphere, 0.25–2.0% gaseous hydrocarbon and having a dewpoint of −60° F or less.

2. The process as defined in claim 1 wherein said step of supplying said atmosphere comprises premixing the constituents thereof and introducing said premixed constituents through a single inlet to said hot zone.

3. The process as defined in claim 1 wherein said step of passing said parts comprises translating said parts at a rate such that the dwell time of said parts in the hot zone is approximately 0.5 hours or less.

4. The process as defined in claim 1 wherein the step of supplying said atmosphere comprises introducing an atmosphere essentially consisting of approximately 99% nitrogen and 1.0% methane into said hot zone.

5. The process as defined in claim 1 wherein the step of supplying said atmosphere comprises introducing an atmosphere essentially consisting of approximately 5.0% hydrogen, 1.0% methane, balance nitrogen into said hot zone.

6. The process as defined in claim 1 wherein the step of supplying said atmosphere comprises introducing an atmosphere essentially consisting of approximately 5% hydrogen, 1% methane, 4% carbon monoxide and balance nitrogen.

7. The process as defined in claim 1 wherein the step of supplying said atmosphere comprises introducing an atmosphere essentially consisting of approximately 1.0% methane, 4.0% carbon monoxide, balance nitrogen into said hot zone.

* * * * *